United States Patent [19]

Toms

[11] 4,326,461

[45] Apr. 27, 1982

[54] TIME DELAY DEVICE

[75] Inventor: Maxwell H. Toms, Essendon, Australia

[73] Assignee: Commonwealth of Australia, Canberra, Australia

[21] Appl. No.: 115,281

[22] Filed: Jan. 25, 1980

[30] Foreign Application Priority Data

Feb. 14, 1979 [AU] Australia ..... PD7673

[51] Int. Cl.[3] ..... F42C 9/06

[52] U.S. Cl. ..... 102/277; 42/1 Z; 89/1 B

[58] Field of Search ..... 102/274, 277, 200, 204; 89/1 B; 42/1 Z

[56] References Cited

U.S. PATENT DOCUMENTS

| | | | |
|---|---|---|---|
| 3,261,293 | 7/1966 | Webb | 102/277 X |
| 3,263,611 | 8/1966 | Loken | 102/277 X |
| 3,296,969 | 1/1967 | Mueller et al. | 102/277 |
| 3,386,334 | 6/1968 | Temple et al. | 89/1 B |
| 3,619,927 | 11/1971 | Robinet | 42/1 Z X |
| 3,640,012 | 2/1972 | Schermuly | 42/1 Z UX |
| 3,766,733 | 10/1973 | Drzewiecki et al. | 102/277 X |
| 3,979,850 | 9/1976 | Schiessl et al. | 42/1 Z X |
| 4,038,924 | 8/1977 | Beermann et al. | 89/1 B X |
| 4,188,856 | 2/1980 | Bendler et al. | 89/1 B |

*Primary Examiner*—David H. Brown

*Attorney, Agent, or Firm*—Kerkam, Stowell, Kondracki & Clarke

[57] ABSTRACT

A time delay device for, in use, combination with a firing device demolition of the type having a pivotable member adapted to release a firing pin to detonate an associated explosive element. The time delay device comprises a pivotable member adapted to release a piston arrangement one end of which arrangement being exposed to fluid within a chamber. A control piston is also provided having one end exposed to fluid in the chamber via a supply port, and a valve is provided to set the rate of transfer of fluid through the supply port under the influence of the pressure exerted by the release of the piston arrangement. In use, the control piston cooperates with the pivotable member of the firing device demolition to hold the pivotable member in a deactivated condition and is subsequently movable to a position under the influence of the fluid pressure, at a rate depending on the setting of the valve, whereby the pivotable member of the firing device demolition will be released and moved to a firing pin release position whereby the firing pin will be released to detonate any associated explosive element.

8 Claims, 4 Drawing Figures

TIME DELAY DEVICE

Figure 1:
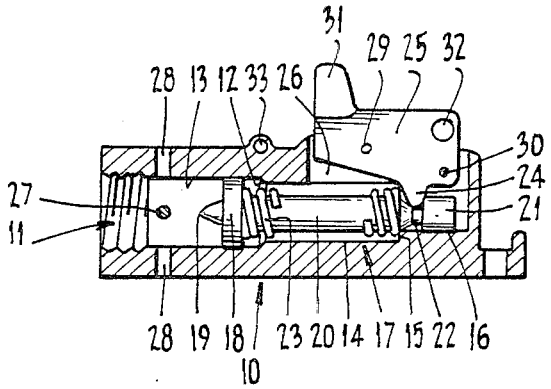
FIG. 1. PRIOR ART

This invention relates to a delay device, and more particularly a time delay device for a firing device demolition.

Time delay devices for use with mines or demolition charges currently consist of cord type safety fuses, electric, electronic and mechanical clocks, and chemical acting devices utilising the corrosive effect of an acid on wire.

The use of cord type safety fuses is restricted to applications of relatively short time duration according to their burning rate, and for relatively long time delays would require large lengths, resulting in a greater weight factor as well as cost. Furthermore, safety fuses when activated produce relatively large quantities of smoke which is of disadvantage in situations where detection is to be avoided.

The use of clocks is quite reliable even over long time durations, and, unlike safety fuses, they do not produce detectable smoke. However, clock devices are relatively expensive, whilst electric or electronic clocks require the use of batteries. Clock devices are also relatively large and often delicate and easily damaged if handled roughly or exposed to adverse environmental conditions such as rain and/or mud.

Chemical type devices usually consist of a glass vial containing an acid mounted adjacent a spring loaded wire restraining a firing pin, such that when the vial is broken the acid spills over the wire and after the time delay taken for the wire to corrode through under the action of the acid the firing pin is released. However, these chemical devices are extremely sensitive to temperature and for the same device the time delay may vary between several hours to many days under varying conditions. Also there is no indication how quickly the wire will break under the corrosive action, and should the glass vial be subjected to internal damage the possibility that the wire will break almost immediately can lead to serious accidents in relation to personnel handling the devices.

It is an object of the present invention to provide an accurate time delay device of low cost, weight and bulk, whilst being simple and safe to operate and use as well as rugged and insensitive to environmental conditions.

The present invention envisages a time delay device for, in use, combination with a firing device demolition of the type having a movable member adapted to release a firing pin to detonate an associated explosive element, said time delay device comprising a movable member adapted to release a piston arrangement, one end of which arrangement being exposed to fluid within a chamber, a control piston having one end exposed to fluid in said chamber via a supply port, and a valve means to set the rate of transfer of fluid through said supply port under the influence of the pressure exerted by the release of said spring loaded piston arrangement, said control piston, in use, cooperating with the movable member of said firing device demolition to hold said movable member in a deactivated condition and movable to a position under the influence of said fluid pressure, at a rate depending on the setting of said valve means, whereby said movable member will be released and move to said firing pin release position whereby said firing pin will be released to detonate any associated explosive element.

Preferably the valve means is adjustable and it will be appreciated that the adjustment of said valve means determines the rate of the transfer of fluid applied to said control piston, and thus determines the rate at which the control piston will move to the position to release the movable member of the firing device demolition.

Figure 2:
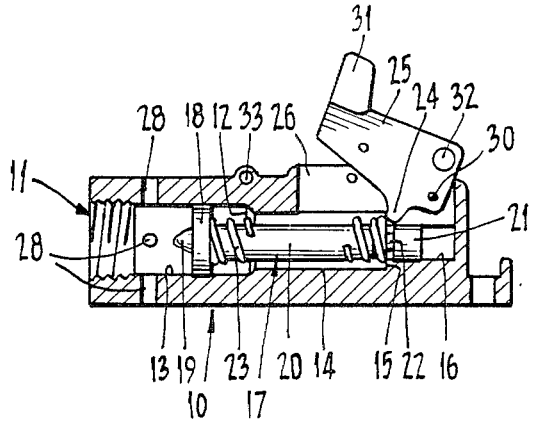
FIG. 2. PRIOR ART
Figure 3:
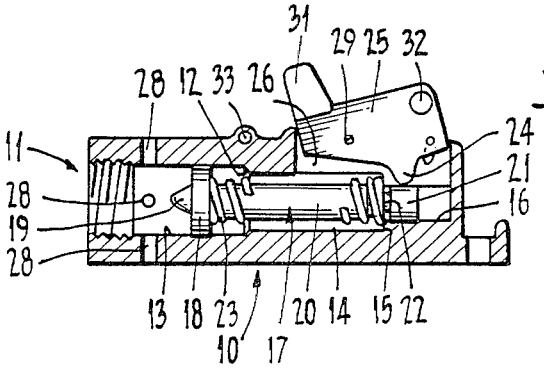
FIG. 3. PRIOR ART
Figure 4:
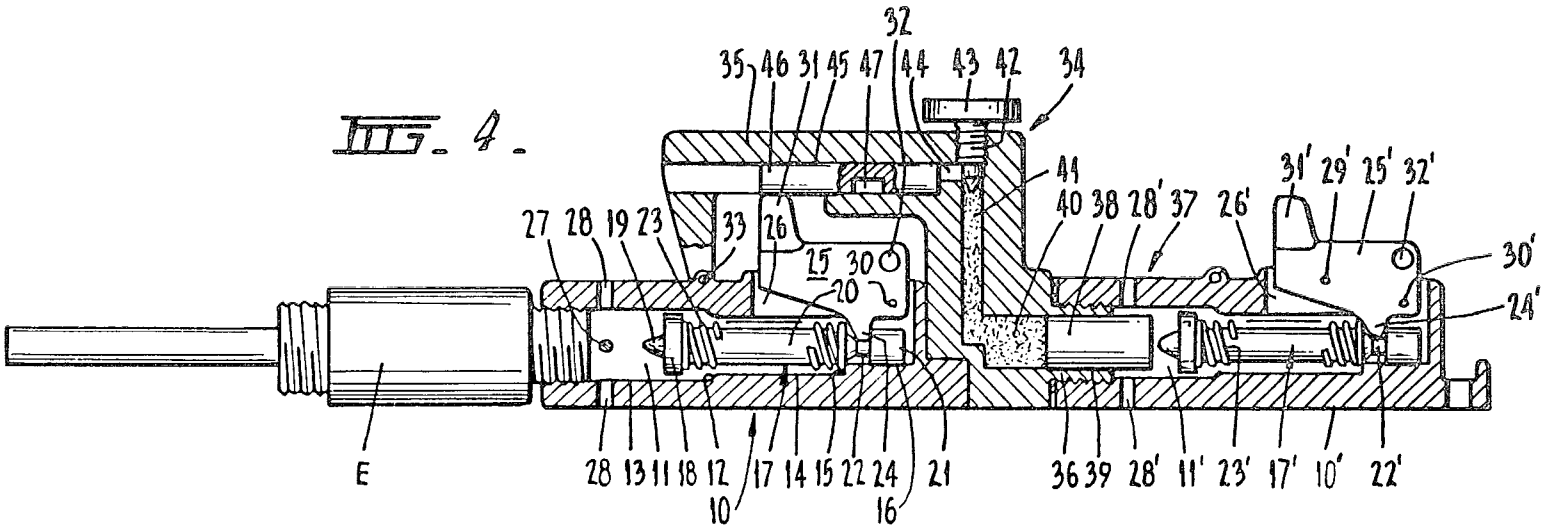

One preferred form of the invention will now be described with reference to the accompanying drawings in which:

FIG. 1 is a side cross-sectional view through a conventional firing device demolition, FIG. 2 is a view similar to that of FIG. 1 showing the manner of operation thereof during one form of actuation thereof, FIG. 3 is a view similar to that of FIG. 1 showing the manner of operation thereof during an alternative form of actuation, and FIG. 4 is a side cross-sectional view of a firing device demolition incorporating a time delay device in accordance with the present invention.

Referring to FIGS. 1 to 3 of the drawings, these drawings show a conventional firing device demolition of the type known as a firing device demolition F1A1 developed by the Engineering Development Establishment in Australia for the Australian Army.

The firing device demolition comprises a housing 10 incorporating an axial bore 11 opening through one end of the housing and terminating just short of the opposite end of the housing. The bore 11 is stepped at 12 to provide a larger diameter bore section 13 at the open end threaded internally for portion of its length as shown, and a smaller diameter section 14 intermediate the length of the housing, whilst the bore is further stepped at 15 to provide a still further smaller diameter bore section 16 adjacent the inner end of the bore. A firing pin 17 is received within the bore 11 and has an enlarged end portion 18 of a diameter matching that of the larger bore section 13 and from which protrudes a tapered point 19. The firing pin further includes a smaller diameter portion 20 extending predominantly through the intermediate section 14 of the bore and an inner end portion 21 of the same diameter as the intermediate portion 20 and corresponding to the diameter of the inner end section 16 of the bore 11, whilst being separated from the intermediate portion 20 by a circumferential groove 22, one side of which is tapered as shown. The firing pin 17 is biased towards the open end of the bore 11 by a compression coil spring 23 surrounding the intermediate portion 20 of the firing pin and between the enlarged end portion 18 and the step 15 of the bore 11. The firing pin is held in the position shown in FIG. 1 against the biasing action of the spring 23 by a sear 24 carried by a sear plate 25 supported in an opening 26 through the wall of the housing 10. A safety pin 27 is passed through one of a number of alternative transversely aligned holes 28 through the wall of a housing which, unless removed, will prevent full axial movement of the firing pin. The sear plate 25 is supported in the opening 26 by two pins, one 29 of smaller diameter and normally having a round head, and the other 30 of larger diameter and normally having a square head. The sear plate 25 also carries a sear plate platform 31, and also incorporates a trip wire hole 32. The housing 11 also incorporates a hole 33 for receiving a captive tie wire for use in fixing the device in position during its use.

Referring to FIG. 2 of the drawings, in a situation where the device is to be activated by release of a pressure applied on the sear plate platform 31, the device is set by removing the pin 29 such that the sear plate will pivot about pin 30 and for completion of setting of the device the safety pin 27 is removed. Upon release of the pressure applied on the sear plate platform 31, the sear plate is free to pivot about pin 30, and as the sear plate no longer prevents movement of the firing pin the biasing action of the spring 23 causes the firing pin to move axially to contact an explosive element (not shown) normally secured to the open end of the device.

Referring to FIG. 3 of the drawings, in an alternative situation where the device is to be activated by pressure, such as foot pressure on the sear plate platform 31, or by tension, such as applied by a trip wire attached through hole 32, the device is set by removing the pin 30 such that the sear plate will pivot about pin 29, and for completion of the setting of the device the safety pin 27 is also removed. Upon application of pressure to the sear plate platform 31 or tension at hole 32, the sear plate pivots about pin 29, the sear 24 moves out of engagement with the groove 22, and the firing pin moves axially under the biasing action of the spring 23 to contact the explosive element (not shown).

In accordance with the present invention the firing device of the type described with reference to FIGS. 1 to 3 cooperates with a time delay device, and a preferred embodiment will now be described with reference to FIG. 4 of the drawings in which the firing device is designated by reference numeral 10, and the integers corresponding with the integers in FIGS. 1 to 3 are given the same reference numerals. In this embodiment it will be observed that the sear plate 25 is only pivoted at pin 30, and pin 29 is dispensed with.

The firing device 10 has a time delay device attached thereto and generally designated as 34, and comprises an additional housing 35 adapted to overlie the sear plate 25 and the opening 26 with an attachment being made at the captive tie wire hole 33. The housing 35 has a threaded extension 36 adapted to receive one end of an actuating device 37. The actuating device 37 is the same as the firing device 10, except for the omission of some integers, insofar as it has a housing 10', a bore 11' stepped in the same manner as for the firing device 10 and incorporating a firing pin 17' with a groove 22' of the same configuration as the firing pin 17. The actuating device further includes a similar biasing spring 23', sear plate 25', and sear 24', opening 26', sear plate platform 31', trip wire hole 32', pins 29' and 30' and holes 28' normally for the safety pin, but not used. The attachment of the housing 35 to the firing device 10 at hole 33 is facilitated by utilising the smaller diameter round head pin 29' from the actuating device 37, and as the pin 29' is the smaller diameter pin and the hole 33 will only match that pin, pin 29' can only be used to facilitate attachment and the larger diameter square head pin 30' cannot be used for that purpose. The manner in which the firing pin 17' is released for axial movement is the same as that disclosed with reference to FIG. 2 that is in response to release of pressure applied on the sear plate platform 31' or by pressure actuated or trip wire tension as disclosed with reference to FIG. 3.

No safety pin 27 is required for the actuating device 37, as the safety facility is provided by the safety pin 27 in the firing device 10. A piston 38 is supported in a bore 39 through the threaded extension of the housing 35, which bore internally of said housing forms part of a chamber 40 containing a fluid. The remainder of the chamber 40 comprises an upwardly extending passage 41 aligned with a threaded hole 42 through the upper wall of the housing 35, which hole receives a needle valve 43. A fluid transfer port 44 is provided in the housing adjacent the inner end of the needle valve 43 and communicates with a cylinder bore 45 having a control piston 46 therein, which control piston has a recess 47 in one side thereof.

With the total device in the deactivated condition, as shown in FIG. 4, the sear plate platform 31 is held in the position shown by engagement against the portion of the control piston 46 remote from the needle valve 43. With the needle valve 43 in the fully "screwed-in" position the transfer port 44 is closed and no fluid can transfer from the chamber 40 into the bore 45 to act on the end of the piston 46. However, on opening of the needle valve fluid transfer can occur and the rate of fluid transfer for a particular situation is set by the degree to which the needle valve is opened. The greater the rate of fluid transfer the quicker the control piston moves, and the slower the rate of transfer the slower is the piston movement. The setting of the needle valve dictates the time delay between actuation of the actuating section 37 and the release of the firing device 10, which occurs when the control piston 46 moves far enough to bring the recess 47 into alignment with the sear plate platform 31 of the firing device, whereafter the sear plate 25 is free to pivot about the pin 30. Due to the lack of resistance offered by the engagement of the sear 24 with the groove 22, once the sear plate is free to pivot about the pin 30, the firing pin is released, and the firing pin 17 wil move axially. Provided the safety pin 27 has been removed the firing pin will then strike and detonate the explosive element E shown which is screw fitted into the end of the firing device.

It will be apparent from the above, that the firing device 10 and the actuating device 37 are comprised of standard firing device demolitions of the type shown in FIGS. 1 to 3 without modification except for the dispensing of some integers, whilst the only additional requirements is the additional housing 34 with the facilities incorporated therein.

In practice silicone fluids will be satisfactory for use in the chamber 40 of the time delay section of the device, as they are temperature stable fluids and will vary little in performance over a wide range of temperatures.

I claim:

1. A time delay device for, in use, combination with a firing device demolition of the type having a movable member which is movable from a deactivated condition, in which it engages and holds a firing pin in a retracted position, to an activated condition disengaged from said firing pin so as to release said firing pin to detonate an associated explosive element, said time delay device comprising a movable member which is movable from a first condition, in which it engages and holds a piston arrangement in a retracted position, to a second condition disengaged from said piston arrangement to release said piston arrangement, said piston arrangement having an end exposed to, and acting upon, fluid within a chamber, a control piston having one end exposed to fluid pressure in said chamber through a supply port, and a valve means to set the rate of transfer of fluid through said supply port under the influence of the pressure exerted by the release of said piston arrangement, said control piston, in use, cooperating with the movable member of the firing device demolition to hold said movable member in said deactivated condition movable to a position, under the influence of said fluid pressure, at a rate depending on the setting of said valve means, whereby said movable member of said firing device demolition will be free to move to said activated condition to release said firing pin.

2. A time delay device as claimed in claim 1, wherein said valve means is adjustable.

3. A time delay device as claimed in claim 1, wherein said movable member for the time delay device is a pivotal member and said piston arrangement is spring loaded and cooperates with said pivotal member via an interengageable protrusion and notch arrangement whereby upon pivoting of said pivotal member said protrusion and notch arrangement will be disengaged to release said piston arrangement for movement under the influence of said spring loading and exert a pressure on the fluid in said chamber.

4. A time delay device as claimed in claim 1, for, in use, combination with a firing device demolition in which said movable member is a pivotal member and said firing pin is a spring loaded firing pin which cooperates with the pivotal member via an interengageable protrusion and notch arrangement, whereby upon pivoting of said pivotal member said protrusion and notch arrangement will be disengaged to release said spring loaded firing pin for movement under the influence of said spring loading to detonate the associated explosive element.

5. A time delay device as claimed in claim 4, wherein the movable member and part of the piston arrangement of said time delay device comprises a pivotal member, a spring loaded firing pin and a protrusion and notch arrangement the same as that for said firing device demolition with which it will be combined in use, and the piston arrangement further includes an operating piston member adapted to be acted upon and moved by the end of said firing pin when said firing pin is released.

6. A time delay device as claimed in claim 5, wherein the pivotal member and said spring loaded firing pin for both the time delay device and the firing device demolition with which it is combined in use, are supported in respective housings, and the time delay device includes a further housing containing said chamber, valve means and control piston, with the housing of said time delay device and said further housing being interconnected with said operating piston member extending from said housing into the chamber in said further housing, with said further housing overlying and attached to the housing of the firing device demolition.

7. A time delay device as claimed in claim 6, wherein said control piston extends adjacent the pivotal member of said firing device demolition and holds the pivotal member in a position where the protrusion and notch arrangement in the firing device demolition is engaged, said control piston incorporating a notch which, when moved into alignment with part of the pivotal member, releases said pivotal member for movement to a position whereby the protrusion and notch arrangement in the firing device demolition is disengaged.

8. A time delay device for, in use, combination with a firing device demolition of the type having a movable member which is movable from a deactivated condition, in which it engages and holds a firing pin in a retracted position, to an activated condition disengaged from said firing pin so as to release said firing pin to detonate an associated explosive element, said time delay device comprising a movable member which is movable from a first condition, in which it engages and holds a piston arrangement in a retracted position, to a second condition disengaged from said piston arrangement to release said piston arrangement, wherein said piston arrangement has an end exposed to, and acting upon, fluid within a chamber, a control piston having an end exposed to fluid pressure in said chamber, said control piston, in use, cooperating with the movable member of the firing device demolition to hold said movable member in said deactivated condition and movable to a position, under the influence of said fluid presure, whereby said movable member of said firing device demolition will be free to move to said activated condition to release said firing pin.

* * * * *